United States Patent [19]

Martinez

[11] Patent Number: 5,069,503

[45] Date of Patent: Dec. 3, 1991

[54] PORTABLE, COLLAPSIBLE MULTI-PURPOSE CHAIR

[76] Inventor: Juan J. Martinez, 555 Cumberland, San Antonio, Tex. 78204

[21] Appl. No.: 521,027

[22] Filed: May 9, 1990

[51] Int. Cl.[5] ..... A47C 4/00

[52] U.S. Cl. ..... 297/54; 297/256; 297/310; 297/37; 297/379

[58] Field of Search ..... 297/16, 17, 19, 115, 297/116, 53, 353, 354, 355, 356, 360, 363-365, 373-376, 378, 379, 252, 255, 256, 27, 28, 29, 35-37, 310, 54

[56] References Cited

U.S. PATENT DOCUMENTS

| | | | |
|---|---|---|---|
| 1,399,744 | 12/1921 | Brophy | 297/417 |
| 2,475,962 | 7/1949 | Horn | 297/252 |
| 2,603,274 | 7/1952 | McClernon | 297/37 |
| 2,702,076 | 2/1955 | Beardsley et al. | 297/252 |
| 2,841,207 | 7/1958 | Sweeney | 297/252 |
| 3,054,637 | 9/1962 | Pambello | 297/256 |
| 3,309,134 | 3/1967 | Roberts | 297/17 |
| 3,765,718 | 10/1973 | Chen | 297/17 |

FOREIGN PATENT DOCUMENTS

| | | | |
|---|---|---|---|
| 647370 | 11/1928 | France | 297/354 |
| 1100938 | 9/1955 | France | 297/364 |
| 64434 | 11/1955 | France | 297/53 |

*Primary Examiner*—Kenneth J. Dorner
*Assistant Examiner*—James M. Gardner
*Attorney, Agent, or Firm*—Hubbard, Thurman, Tucker & Harris

[57] ABSTRACT

A chair which is usable as an ordinary seat, as a stadium seat, or as a beach seat comprises a generally quadralateral seat element having rigid side membes. A back support is pivotally secured to a rear end of the seat element to permit the back element to be moved from a collapsed position overlying the top of the seat to a support position extending upwardly in an inclined direction relative to the seat. A pair of arm elements are pivotally secured to the side frames of the seat and are pivotally movable between a position overlying the top of the seat and an upstanding position wherein the arm rests are disposed vertically above each side of the seat. Leg frames are provided having a generally inverted U-shaped configuration with the bight portion of the U-shape pivotally secured respectively to the side frames of the seat. The leg frames are pivotally movable from a position underlying the bottom portion of the seat to a position depending generally vertically downwardly from the seat. Additional features include a clamp element engagable with a stadium seat or a park bench to secure the seat frame in a fixed position relative to such support, and anti-tipping rods to provide support of the seat when the seat is used as a beach chair. The entire construction can be folded into a compact, generally rectangular package which can be readily inserted in a suitable carrying case.

16 Claims, 4 Drawing Sheets

PORTABLE, COLLAPSIBLE MULTI-PURPOSE CHAIR

BACKGROUND OF THE INVENTION

1. Field of the Invention: The invention relates to a multi-purpose chair which is collapsible into a portable configuration of a generally rectangular box-like shape.

2. Summary of the Prior Art: Chairs for a variety of purposes have been known in the art for many years. Generally, however, a chair that is employed as a table chair needs only a seat element, leg elements and a back support element. When a chair is to employed in a more comfortable, living room environment, the addition of arm rests is a necessity. When, however, a seat is to be utilized in a stadium and clamped to the conventional board seats found in stadiums, or on park tables, then there is no need for the leg elements but the seat must be provided with a clamp to prevent it from moving off the stadium seat or park table. When the seat is to be employed on the beach, there is again no need for the leg elements, yet there is need for providing support of the seat against backwards tilting as the occupier stretches out his/her legs and leans back against the backrest.

Chairs for individually accomplishing each of these common functions are well known in the art. What is missing in the prior art, however, is a single chair construction capable of fulfilling all of the aforementioned functions, yet which is readily collapsible into a generally rectangular box-like configuration to make it conveniently portable from the home to the stadium, park or the beach.

SUMMARY OF THE INVENTION

This invention provides a multi-purpose chair which is conveniently collapsible into a generally rectangular box-like configuration to provide portability of the chair between the home and uses exterior of the home. The invention comprises a generally rectangular seat element having rigid front, rear and side frame elements for securement thereto of various appendages to be utilized for the forming of the chair. A backrest is provided having a pivotal connection to a horizontal rod element secured in spaced parallel relationship to the rear frame element of the seat. Means are provided for permitting pivotal movement of the backrest between a folded position overlying the seat to an upwardly and rearwardly inclined position relative to the seat to provide support to the back of any person sitting on the seat. Manually operable means are provided for latching the backrest in its upward, inclined position.

A pair of leg frame elements are provided which are of generally inverted U-shaped configuration. The bight portion of the U-shape is formed by a tubular member which is pivotally mounted on a support rod extending parallel to, but spaced from, the respective side frame elements of the seat.

The leg frames are pivotally mounted for movement between a position underlying the seat to a generally vertically depending position for supporting the seat at a normal height relative to the floor. Manually operable means are provided for securing each leg frame element in its depending, substantially vertical position relative to the seat.

If desired, a pair of arm rests may be mounted to the seat by virtue of the frames for such arm rests terminating in a tubular element which snaps around the medial portion of the tubular bight portion of the respective leg frame. Manually operable means are provided to effect the securement of the arm rest frames in a desired upstanding position. Release of such manually operable means permits the arm rests to be folded downwardly into overlying, adjacent relationship to the top of the seat. Normally the arm rests lie on top of the backrest when the backrest is folded to its overlying position relative to the seat. A reduction in the width of the backrest will obviously permit the arm rests to be folded to a lower position adjacent the seat by being located on each lateral edge of the folded backrest.

From the foregoing description, it is readily apparent that the backrest, arm rest and leg frames may be readily folded into their adjacent overlying and underlying positions respectively relative to the seat, thus forming a compact rectangular box-like structure which can be readily transported in a canvass or fabric bag.

To utilize the aforedescribed chair as a stadium seat, or as a seat which can be secured to the bench portion of a park table, this invention contemplates mounting a generally U-shaped clamp element in depending relation to the rear frame element of the seat wherein it may be engaged with the forward edge of a stadium bench seat or a park table bench seat. A suitable manually operable clamp bolt is provided on the U-shaped element to provide a clamping engagement with the bench seat.

Extension bar elements may be slidably mounted in the seat frame parallel to the side frames. When such extension elements are pulled rearwardly to an extreme position relative to the seat, they will function as an anti-tipping support whenever it is desired to utilize the chair on the beach. Such support is necessary to prevent the tipping of the chair rearwardly whenever a person occupying the seat stretches his or her legs and leans backwards against the backrest.

It is therefore readily apparent that a chair embodying the construction of this invention will not only satisfy a plurality of uses but still retains the ability to be collapsed into a compact, generally rectangular box-like configuration for ready transport in the family car whenever uses of the seat away from the home are contemplated.

Further objects and advantages of the invention will be readily apparent from the following detailed description, taken in conjunction with the annexed sheets of drawings, on which is shown, by way of preferred example only, one embodiment of the invention.

DESCRIPTION OF PREFERRED EMBODIMENT

Figure 1:
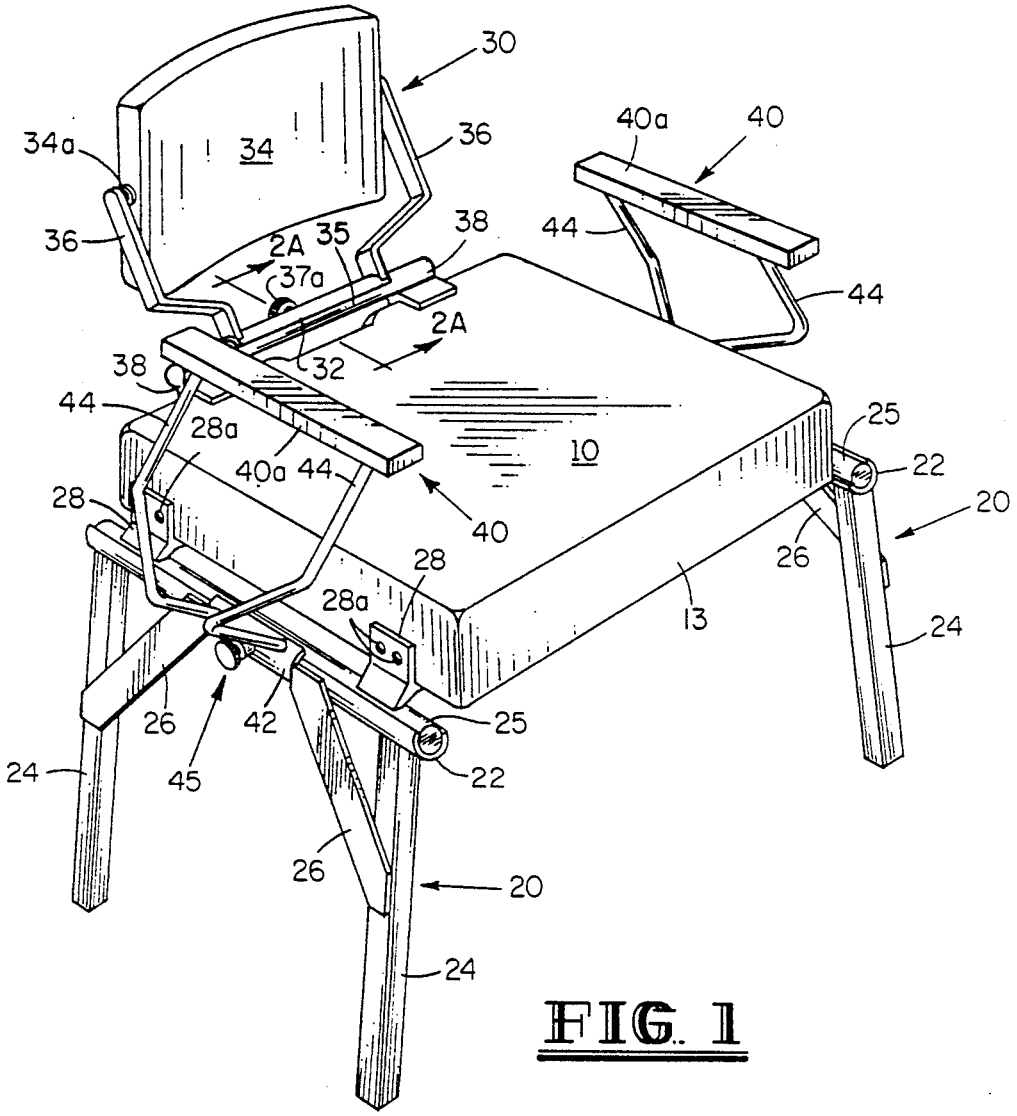
FIG. 1 is a perspective view illustrating a multi-purpose, collapsible chair embodying this invention with the elements thereof disposed in the positions utilized for using the device as a seat with a backrest and arm rests.

Referring to FIG. 1, a chair 1 embodying this invention will be seen to comprise a seat 10 to which a pair of leg frames 20 are pivotally secured to each side of the seat 10. A backrest 30 is pivotally secured to the back edge of the seat 10 and arm rests 40 are pivotally secured to each side of the seat 10.

Figure 9:
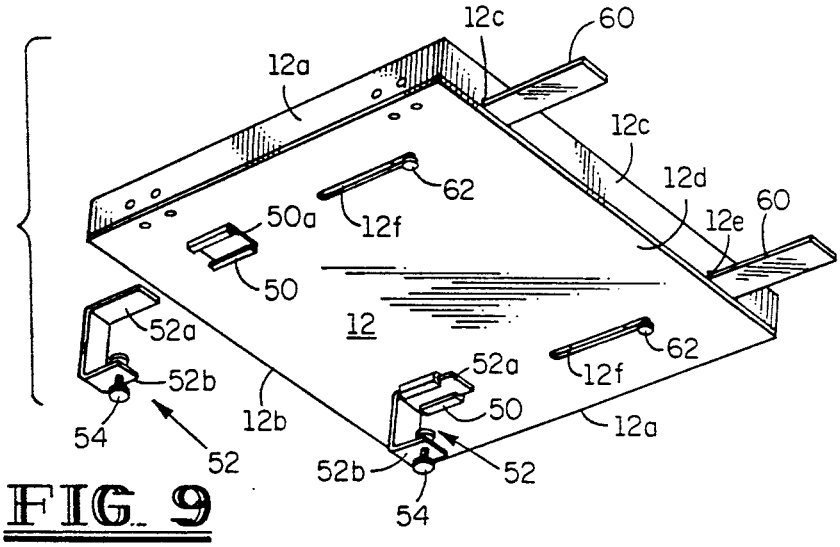
FIG. 9 is an exploded perspective view of the seat frame illustrating the mounting of the anti-tilt bars.

Referring now to FIG. 9, the internal structure of the seat 10 is illustrated as comprising a box-like frame 12 having rigid angle iron side frames 12*a*, a front frame 12*b* and a rear frame 12*c*. In addition, a bottom seat panel 12*d*, which is illustrated as being a solid sheet but could be comprised of a plurality of spaced frame members, is suitable secured, as by welding, to the front, back and side frame members. The covering 13 for the seat 10 may be a molded foam plastic or may, if desired, be cloth conventionally secured around a foam plastic seat element. The upholstering of the seat 10 forms no part of the instant invention.

The two leg frame structures 20 are substantially identical and each has an inverted U-shaped configuration with the bight portion 22 being formed as a semi-tubular member which is welded at each end to the top ends of two leg elements 24. Angular braces 26 also rigidly interconnect the tubular element 22 with each of the leg elements 24.

To effect the pivotal mounting of each leg frame to the seat frame 12, a support rod 25 is welded to two axially spaced, angle shaped brackets 28 which in turn are secured by screws 28*a* to the respective side frame element 12*a* of the rigid frame structure 12. The semi-tubular top frame element 22 of each leg frame 20 is provided with an axially extending slot 22*a* which permits the tubular element 22 to be slid or snapped over the support rod 25 and to be secured thereto in telescopic engagement. Thus, the slot 22*a* has an angular extent of slightly less than 180° to permit the ready expansion of the slot 22*a* to slide on or snap over the respective support rod 25, clearing brackets 28 and pivotally securing each leg frame 20 to the side frames 12*a* of the seat frame 12.

Figure 4A:
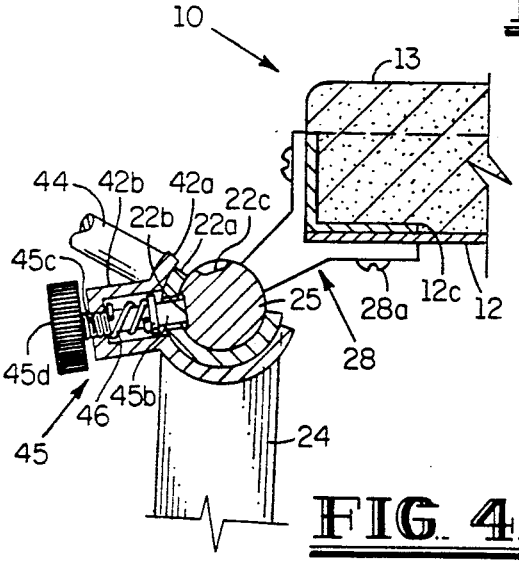
FIG. 4A is a sectional view taken on the plane 4A—4A of FIG. 3 illustrating the position of the arm rest latching mechanism when the arm rests are in their upstanding, usable positions.
Figure 4B:
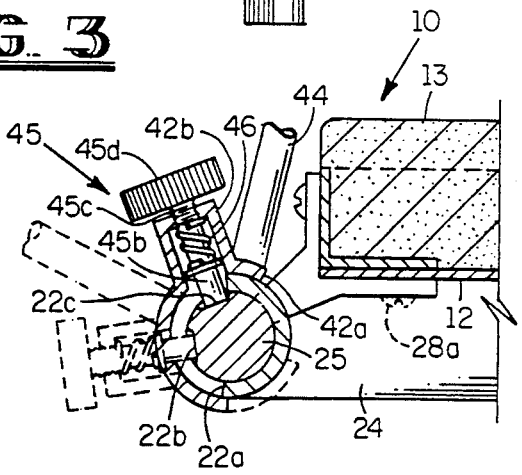
FIG. 4B is a view similar to FIG. 4A but illustrating the position of the latching mechanism when the leg frames are in their collapsed, folded positions.
Figure 5:
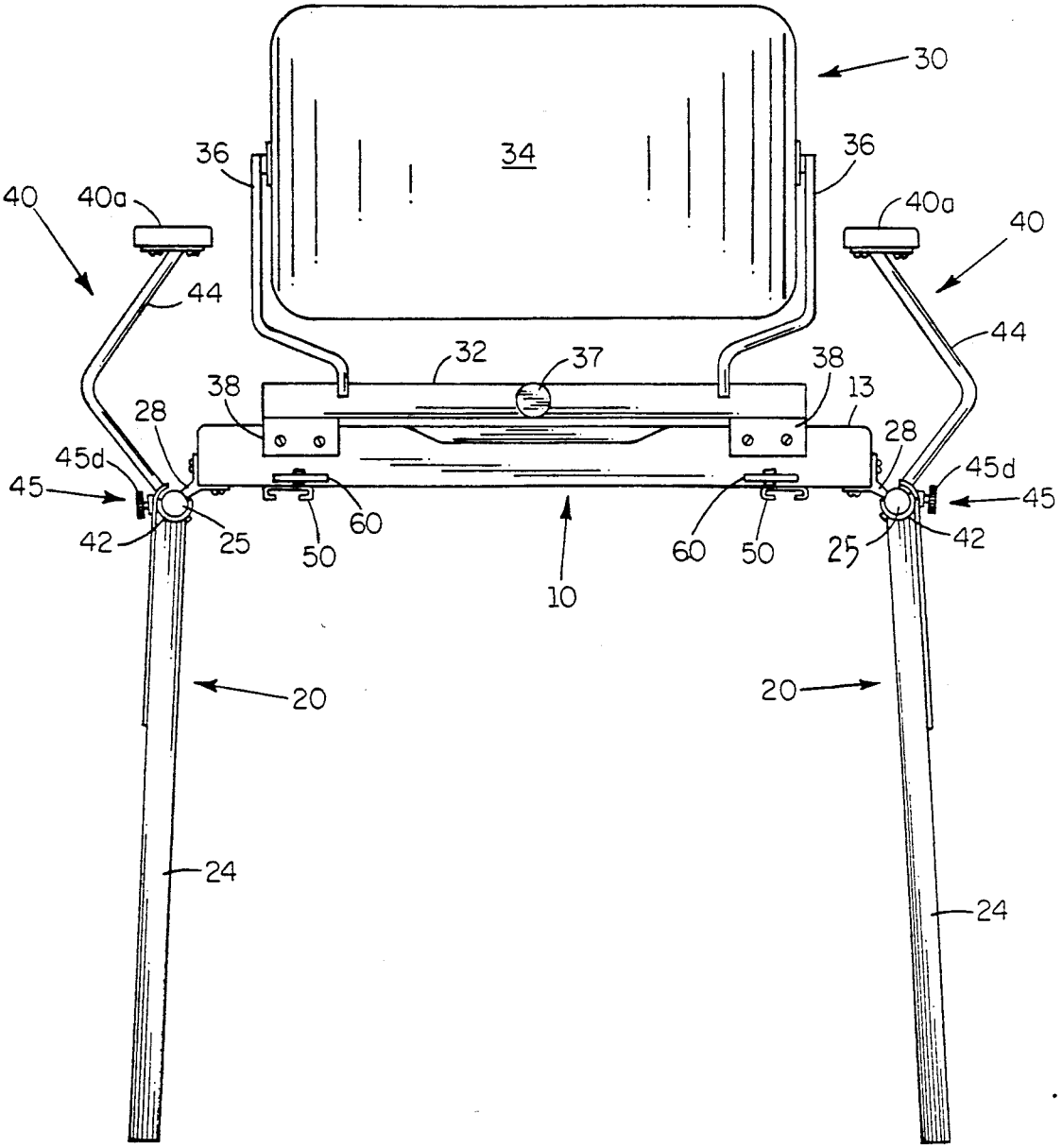
FIG. 5 is an enlarged scale rear elevational view of FIG. 1.
Figure 6:
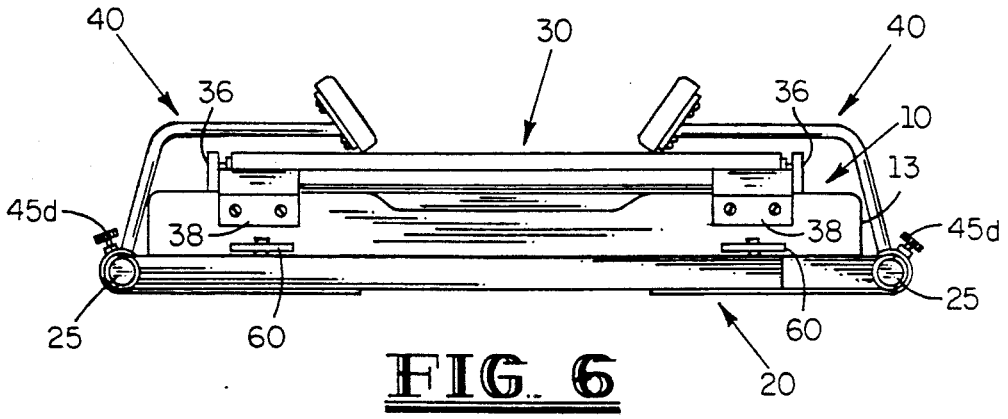
FIG. 6 is an enlarged scale elevational view of the chair assemblage in its collapsed folded position, ready for transport.

The legs 24 are thus foldable between a downwardly depending, somewhat inclined position relative to the seat 10 as shown in FIG. 1 to a collapsed position lying adjacent to the bottom 12*d* of the seat frame 12 as illustrated in FIGS. 4B and 6. The legs 24 of one leg frame are offset forwardly or rearwardly relative to the legs of the other frame to avoid interference in their folded positions. The leg frames 20 are each secured in their operative positions by a manually releasable, spring pressed detent 45, which will be described in connection with the mounting of the side arms 40.

The backrest 30 comprises a generally U-shaped rigid frame structure having a bight portion 32 which is of semi-tubular configuration. A back support 34 may be rigidly secured to the upstanding arms 36 of the U-shaped frame, but preferably is pivotally secured thereto by pivot bolts 34*a*. As best shown in the sectional views of FIGS. 2A and 2B, the semi-tubular element 32 of the backrest assemblage 30 is telescopically mounted around a support rod 35 which has angle-shaped brackets 38 welded thereto and secured by screws 38*a* to the back frame element 12*c* of the seat frame 12.

The same mounting technique is employed for the backrest 30 as was utilized for the leg frames 20. Thus, the semi-tubular member 32 is provided with an elongated slot 32*a* which is less than 180° in arcuate configuration, permitting the semi-tubular member to be slid or snapped around the support rod 35 and pivotally secured thereto, with the slot 32*a* clearing the brackets 38.

Figure 2A:
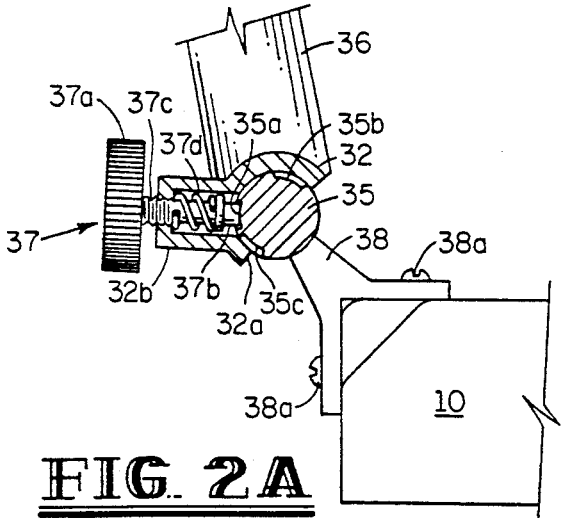
FIG. 2A is a sectional view taken on the plane 2AA of FIG. 1 illustrating the latch position when the backrest is in its operative position.
Figure 2B:
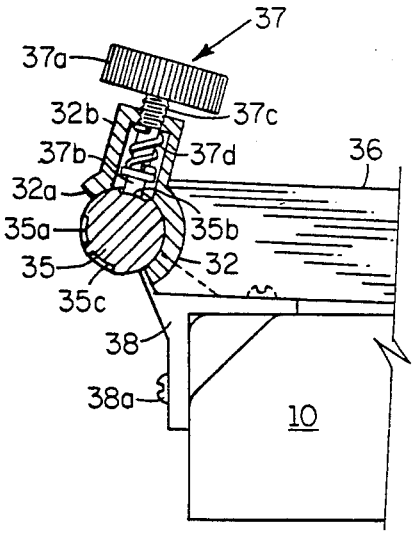
FIG. 2B is a sectional view similar to FIG. 1, but illustrating the latch position when the backrest is in its collapsed folded position.
Figure 3:
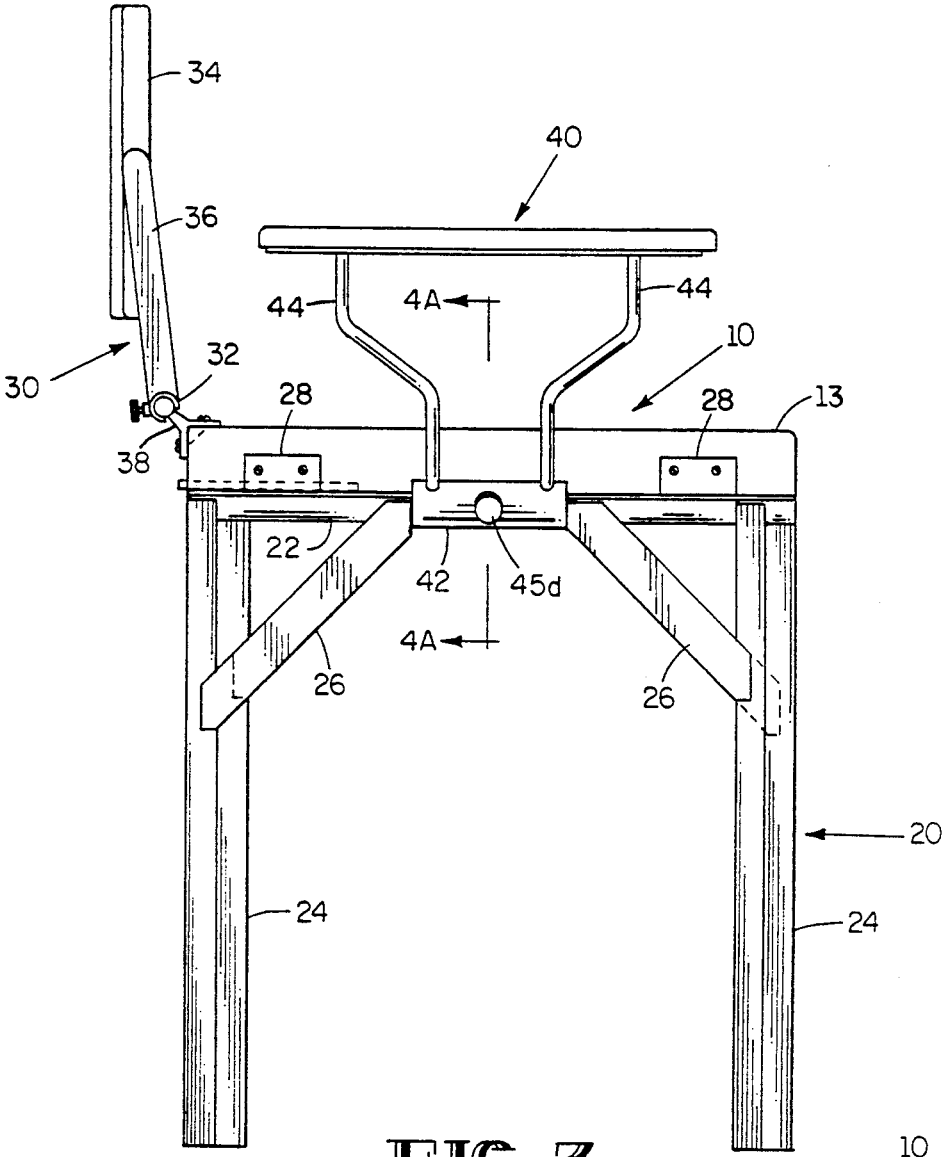
FIG. 3 is a side elevational view of FIG. 1.

The backrest 30 is thus foldable from the upright, inclined position shown in FIG. 1 to a collapsed position overlying the seat 10 as shown in FIG. 2B. To secure backrest 30 in its operative position, a spring pressed, manually releasable latch 37 is mounted in a radial housing 32*b* which is welded to the semi-tubular element 32. The latch element 37 includes a thumbwheel 37*a* which is rigidly secured to a rod 37*b*. Rod 37*b* has a threaded portion 37*c* at its end adjacent the thumbwheel 37*a* which engages threads provided in the end of the housing 32*b*. The other end of the rod 37*b* engages a recess or notch 35*a* provided upon the periphery of the support rod 35 and is spring biased into such engagement by a spring 37*d*. It will be apparent that the manually releasable latching mechanism 37 can, by rotation of the thumbwheel 37*a*, lock the rod 37*b* into engagement with the recess 35*a* provided on the support rod 35. FIG. 2A illustrates the locking of the back frame assemblage 30 in its upright position, as shown in FIG. 1, while FIG. 2B illustrates the locking of the back frame assemblage 30 in its collapsed position wherein the back support 34 occupies a position overlying the seat 10. In this position, the end of rod 37*b* of the latching detent 37 is in engagement with a second depression 35*b* provided on the periphery of the support rod 35.

Each of the arm rests 40 comprises an arm supporting member 40*a* which is rigidly secured to the top end of a U-shaped frame structure including a semi-tubular bight portion 42 and arm portions 44. The arm portions are bent so as to insure clearance of the upholstered seat 13 when the arm rests 40 are folded to a collapsed position overlying such seat (FIGS. 4B and 6). The semi-tubular element 42 has a sufficiently large bore diameter to be telescopically mounted on the semi-tubular frame element 22 of the leg frames 20. The semi-tubular element 42, as best shown in FIG. 4A, is provided with an elongated notch 42*a*, the angular extent of which is slightly less than 180° to permit such element 42 to be snapped into telescopic engagement with the semi-tubular element 22. A manually operable latching mechanism 45 is provided for securing the seat frames 40 in either their upright operative positions as illustrated in FIG. 1, or in a folded position overlying the upholstered seat 13. To reduce the bulk of the collapsed chair, it is preferable that the space between the arm supporting portions 40*a* be sufficiently large to permit such arms, when folded, to lie on opposite sides of the backrest arms 36; however, this is not a necessity and the arm units 40 may be pivoted into an overlying relationship relative to the collapsed backrest 30 as shown in FIG. 6.

The latching mechanism 45 comprises a housing 42*b* projecting radially from the semi-tubular frame element 42. Such housing has internal threads in its outer end which cooperate with the threaded portion 45*c* of a rod 45*b* which is secured at its outer end to a thumbscrew 45*d*. The rod 45*b* is biased radially inwardly by a spring 46 and the inner end of the rod 45*b* projects through a radial hole in the semi-tubular frame member 22 and engages a notch or recess 22*b* formed on the periphery of the support 22. Thus, the manually operable latching mechanism 45 effects the securement of both the leg frames 20 and the arm rest frames 40 in their operative and collapsed positions. In their collapsed positions, as shown in FIG. 4B, the inner end of the rod 45*b* engages a second recess 22*c* formed on the support rod 22.

From the foregoing description, it is apparent that a chair embodying this invention, can incorporate foldable legs, a backrest, and foldable arms, yet permit the chair to be folded into a compact, generally rectangular box-like configuration as shown in FIG. 6 for convenient transport.

Figure 7:
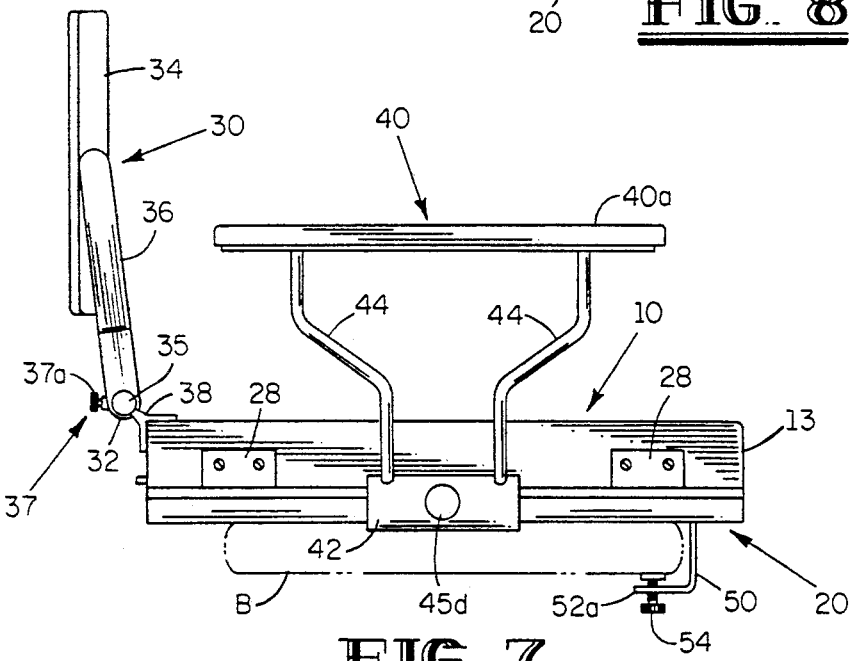
FIG. 7 is a side elevational view of the chair when used as a stadium or park bench seat.

To further broaden the utility of the chair embodying this invention, generally U-shaped brackets 50 (FIG. 9) are secured in spaced relationship to the bottom surface 12*d* of the chair frame 12 near the front edge thereof and define re-entrant channels 50*a*. A U-shaped clamp 52 has one arm 52*a* insertable in channel 50*a*. The other arm 52*b* mounts a manually operable clamping bolt 54. This permits the frame structure 12 to be securely clamped to a stadium or park bench seat B shown in FIG. 7. In this position, it will be noted that the leg frame elements 20 are folded to their collapsed positions adjacent the bottom surface 12*d* of the seat frame 12.

Figure 8:
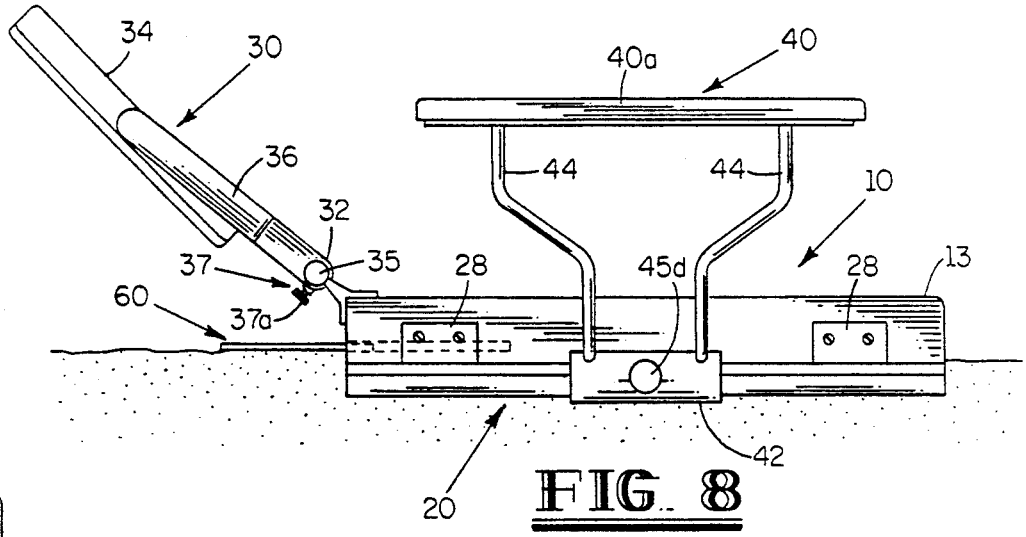
FIG. 8 is a view similar to FIG. 7 but showing the fully extended positions of the anti-tilt bars for the chair when employed as a beach chair.

Still another use for the chair embodying this invention is illustrated in FIG. 8. Again, the leg frames 20 are folded to their collapsed position underlying the seat 10. A pair of support bars 60 are respectively slidably mounted in laterally spaced relationship within notches 12*e* formed within the rear wall 12*c* of the seat frame 12. The extent of forward and rearward movement of each support bar 60 is controlled by a bolt 62 which traverses a longitudinal slot 12*f* provided in the seat frame bottom 12*d* below each support bar 60 and is threadably engaged with the respective bar 60. Bolts 62 also provide a convenient gripping surface for the hand to pull the bars 60 to their fully extended position as illustrated in FIG. 8 to function as an anti-tilt support for the chair 1 when utilized on the beach or when set on grass or on other surface to provide a low level seat permitting the occupier to lean back against the backrest 30 and extend his/her feet outwardly in a substantially horizontal position. The bars 60, when so extended prevent an undesired rearward tilting of the seat 1 when so used.

If a further inclination of the backrest 30 is desired, a third indentation 35*c* (FIG. 2A) may be provided in support rod 35 to secure the backrest in the 45° position shown in FIG. 8.

Those skilled in the art will recognize from the foregoing description that a chair embodying this invention provides in a single unit a construction that is capable of multiple uses. It is still capable of being folded into a very compact, convenient configuration for transport.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A portable chair comprising:

a quadrilateral seat having rigid peripheral front, side and rear frame elements;

a pair of arm rests, each arm rest having a depending U-shaped frame structure having a horizontal base portion;

means for horizontally pivotally securing said horizontal base portion of said U-shaped frame respectively to said side frame elements for movement between collapsed positions adjacent said seat and elevated positions respectively above each said side element of said seat;

a back rest having a back engaging element mounted on a rigid frame structure including a rigid bottom element;

means for horizontally pivotally securing said rigid bottom element of said back rest to said rear frame element of said seat for movement of said back rest between a collapsed horizontal position adjacent said seat and an upwardly and rearwardly inclined position relative to said seat;

a horizontal support rod secured to each side frame element of said seat in spaced, parallel relationship;

a pair of leg frames;

tubular means on the top of each said leg frame for pivotally engaging said support rod for movement of each leg frame between a collapsed position underlying said seat to a substantially vertical position to vertically support said seat thereon; and manually releasable means for securing each said tubular means against movement relative to the respective support rod in said substantially vertical position.

2. The apparatus of claim 1 wherein said manually releasable means comprises a spring pressed detent.

3. The apparatus of claim 1 wherein said horizontal base portion of said U-shaped frame of each said arm rest is semi-tubular, and said means for respectively pivotally securing said base portion to said seat side frame comprises a telescopic engagement of said semi-tubular base portion with said respective tubular means on said leg frame;

said semi-tubular horizontal base portion having a bore diameter slightly greater than said leg frame tubular means and further having an elongated slot of slightly less than 180° arcuate width, thereby permitting each said semi-tubular base portion to be snapped around the respective leg frame tubular means.

4. The apparatus of claim 1 wherein said rigid bottom element of said back rest comprises:

a semi-tubular member, and said means for horizontally pivotally securing said semi-tubular member to said rear frame element of said seat comprises a support rod secured to said rear frame element in laterally spaced, parallel relationship thereto;

said semi-tubular member having a bore diameter slightly larger than said support rod; and said semi-tubular member further having an elongated slot of slightly less than 180° in arcuate extent to permit said semi-tubular member to be snapped around said support rod.

5. The apparatus of claim 1 wherein said tubular means comprises:

a semi-tubular member having a bore diameter slightly larger than said support rod; and said semi-tubular member further having an elongated slot of slightly less than 180° in arcuate extent to permit said semi-tubular member to be snapped around said support rod.

6. The apparatus of claim 1 further comprising means depending from said seat frame for clamping said seat to a bench seat.

7. The apparatus of claim 1 further comprising at least one tip over prevention bar shiftably mounted on said seat frame for movement to a rearwardly projecting position, thereby permitting use of said chair as a beach chair.

8. The apparatus of claim 1 further comprising means depending from said seat frame for clamping said chair to a bench seat.

9. A foldable, portable chair comprising:

a generally quadrilateral seat having peripherally disposed, rigidly interconnected, horizontal front, rear and two side frame elements;

a back support having a rigid bottom frame member;

means for pivotally securing said rigid bottom member to said rear frame element of said seat for pivotal movement in a vertical plane relative to said seat from a substantially horizontal position overlying said seat to a vertically inclined position;

a pair of identical arm rest, each arm rest having a rigid bottom frame element;

means for respectively pivotally securing said rigid bottom frame elements of said arm rests to said side frame elements of said seat for movement in a vertical plane from a substantially horizontal position overlying said seat to a substantially vertical position;

a pair of identical leg frames, each having a pair of legs connected in depending relation to a rigid top frame element;

means for respectively securing said rigid top frame elements of said leg frames to said side frame elements of said seat for movement in a vertical plane from a horizontal position underlying said seat to a substantially vertical depending position relative to said seat, thereby supporting said seat in an elevated position relative to a floor;

said back support, said arm rests and said leg frames being concurrently foldable into their respective overlying and underlying positions relative to said seat to form a compact box-like unit for transport; and depending from said seat frame for clamping said seat to a bench seat.

10. A foldable, portable chair comprising:

a generally quadrilateral seat having peripherally disposed, rigidly interconnected, horizontal front, rear and two side frame elements;

a back support having a rigid bottom frame member;

means for pivotally securing said rigid bottom member to said rear frame element of said seat for pivotal movement in a vertical plane relative to said seat from a substantially horizontal position overlying said seat to a vertically inclined position;

a pair of identical arm rests, each arm rest having a rigid bottom frame element;

means for respectively pivotally securing said rigid bottom frame elements of said arm rests to said side frame elements of said seat for movement in a vertical plane from a substantially horizontal position overlying said seat to a substantially vertical position;

a pair of identical leg frames, each having a pair of legs connected in depending relation to a rigid top frame element;

means for respectively pivotally securing said rigid top frame elements of said leg frames to said side frame elements of said seat for movement in a vertical plane from a horizontal position underlying said seat to a substantially vertical depending position relative to said seat, thereby supporting said seat in an elevated position relative to a floor;

said back support, said arm rests and said leg frames being concurrently foldable into their respective overlying and underlying positions relative to said seat to from a compact unit for transport; and a tip over prevention bar shiftable mounted within said seat frame for movement to a rearwardly projection position, thereby permitting use of said chair as a beach chair with said leg frames pivoted to said underlying position relative to said seat.

11. A portable chair comprising:

a quadrilateral seat having rigid peripheral front, side and rear frame elements;

a backrest having a back engaging element mounted on a rigid frame structure including a rigid bottom element;

means for horizontally pivotally securing said rigid bottom element of said backrest to said rear frame element of said seat for movement of said backrest between a collapsed horizontal position adjacent said seat and an upwardly and rearwardly inclined position relative to said seat;

a horizontal support rod secured to each side frame element of said seat in spaced, parallel relation thereto;

a pair of leg frames;

tubular means on the top of each said leg frame for pivotally engaging said support rod for movement of the leg frame between a collapsed position underlying said seat to a substantially vertical position to vertically support said seat thereon; and manually releasable means for securing each said tubular means against movement relative to the respective support rod in said substantially vertical position.

12. The apparatus of claim 11 wherein said manually releasable means comprises a spring pressed detent.

13. The apparatus of claim 11 wherein said tubular means comprises:

a semi-tubular member having a bore diameter slightly larger than said support rod; and said semi-tubular member further having an elongated slot of slightly less than 180° in arcuate extent to permit said semi-tubular member to be snapped around said support rod.

14. The apparatus of claim 11 further comprising means depending from said seat frame for clamping said seat to a bench seat.

15. The apparatus of claim 11 further comprising at least one tip over prevention bar shiftably mounted on said seat frame for movement to a rearwardly projecting position, thereby permitting use of said chair as a beach chair with said leg frames pivoted to said underlying position relative to said seat.

16. The apparatus of claim 11 further comprising means depending from said seat frame for clamping said chair to a bench seat.

* * * * *